US011920581B2

(12) United States Patent
Pham

(10) Patent No.: US 11,920,581 B2
(45) Date of Patent: Mar. 5, 2024

(54) FLOW RATE CONTROL FOR PUMP WITH FLOW SENSOR

(71) Applicant: Masterflex, LLC, Radnor, PA (US)

(72) Inventor: Phuong Le Pham, Mount Prospect, IL (US)

(73) Assignee: Masterflex LLC, Radnor, PA (US)

( * ) Notice: Subject to any disclaimer, the term of this patent is extended or adjusted under 35 U.S.C. 154(b) by 515 days.

(21) Appl. No.: 17/162,973

(22) Filed: Jan. 29, 2021

(65) Prior Publication Data

US 2022/0243721 A1 Aug. 4, 2022

(51) Int. Cl.
*F04B 49/20* (2006.01)
*F04B 43/08* (2006.01)
(Continued)

(52) U.S. Cl.
CPC ..... *F04B 49/20* (2013.01); *F04B 43/08* (2013.01); *F04B 49/065* (2013.01);
(Continued)

(58) Field of Classification Search
CPC ..... F04B 49/20; F04B 49/065; F04B 49/103; F04B 2201/1201; F04B 2203/0209;
(Continued)

(56) References Cited

U.S. PATENT DOCUMENTS 3,990,444 A 11/1976 Vial
4,715,786 A 12/1987 Wolff et al.
(Continued)

FOREIGN PATENT DOCUMENTS

CA 2198907 A1 3/1996
CN 101274113 A 10/2008
(Continued)

OTHER PUBLICATIONS

European Search Report for related EP Application No. 22153760 dated May 15, 2022, 9 pages.
(Continued)

*Primary Examiner* — Christopher S Bobish

(74) *Attorney, Agent, or Firm* — Faegre Drinker Biddle & Reath LLP

(57) ABSTRACT

Aspects are provided for positive displacement pumps and methods and systems for controlling such pumps for dispensing at a flow rate based on a downstream flow sensor. A pump controller determines a targeted motor speed for a flow rate set point based on a flow rate function. The pump controller determines a predicted movement time for a motor of the pump to change from a current motor speed to the targeted motor speed, a predicted wait time to reach a flow rate corresponding to the targeted motor speed, and a measurement time after the wait time. The pump controller controls the positive displacement pump according to consecutive control cycles, each control cycle includes a pump movement sub-cycle, a wait sub-cycle, and a measurement sub-cycle. The pump controller determines a measured flow rate during the measurement sub-cycle. A subsequent control cycle is based on the measured flow rate.

19 Claims, 9 Drawing Sheets

(51) Int. Cl.
*F04B 43/12* (2006.01)
*F04B 49/06* (2006.01)
*F04B 49/10* (2006.01)

(52) U.S. Cl.
CPC ..... *F04B 49/103* (2013.01); *F04B 43/12* (2013.01); *F04B 2201/1201* (2013.01); *F04B 2203/0209* (2013.01); *F04B 2205/09* (2013.01); *F04B 2207/043* (2013.01)

(58) Field of Classification Search
CPC ..... F04B 2205/09; F04B 2207/043; F04B 43/08; F04B 43/12
See application file for complete search history.

(56) References Cited

U.S. PATENT DOCUMENTS

| | | | | |
|---|---|---|---|---|
| 4,981,467 | A | 1/1991 | Bobo, Jr. et al. | |
| 5,915,932 | A | 6/1999 | Nabity et al. | |
| 5,951,510 | A * | 9/1999 | Barak | A61M 5/16859 604/67 |
| 6,783,328 | B2 * | 8/2004 | Lucke | A61M 60/178 417/43 |
| 7,874,808 | B2 * | 1/2011 | Stiles | F04D 15/00 417/18 |
| 8,801,389 | B2 * | 8/2014 | Stiles, Jr. | F04B 49/22 417/42 |
| 8,858,494 | B2 * | 10/2014 | Nelson | F04B 43/0081 417/477.6 |
| 9,017,039 | B2 * | 4/2015 | Toyota | F04B 49/20 417/44.2 |
| 9,119,917 | B2 | 9/2015 | Blomquist | |
| 9,283,332 | B2 | 3/2016 | Unverdorben | |
| 9,341,178 | B1 * | 5/2016 | Williams | F04B 49/06 |
| 9,408,968 | B2 | 8/2016 | Browne et al. | |
| 9,567,992 | B2 * | 2/2017 | Heide | A61M 60/443 |
| 9,777,733 | B2 * | 10/2017 | Stiles, Jr. | F04D 15/0066 |
| 9,970,433 | B2 * | 5/2018 | Marioni | F04B 49/20 |
| 10,112,009 | B2 | 10/2018 | Dudar et al. | |
| 10,415,562 | B2 * | 9/2019 | Kajita | E21B 43/2607 |
| 10,632,264 | B2 | 4/2020 | Toshima | |
| 2002/0150476 | A1 | 10/2002 | Lucke et al. | |
| 2005/0256388 | A1 | 11/2005 | Susi | |
| 2007/0038191 | A1 | 2/2007 | Burbank et al. | |
| 2007/0060786 | A1 | 3/2007 | Gura et al. | |
| 2007/0060874 | A1 | 3/2007 | Nesbitt et al. | |
| 2008/0092961 | A1 | 4/2008 | Bair et al. | |
| 2008/0145249 | A1 | 6/2008 | Smisson et al. | |
| 2009/0075129 | A1 | 3/2009 | Sparks et al. | |
| 2010/0209263 | A1 | 8/2010 | Mazur | |
| 2010/0292635 | A1 | 11/2010 | Sundar | |
| 2010/0324465 | A1 | 12/2010 | Vinci et al. | |
| 2011/0052416 | A1 * | 3/2011 | Stiles | F04D 15/0066 417/42 |
| 2013/0336814 | A1 | 12/2013 | Kamen et al. | |
| 2014/0171869 | A1 | 6/2014 | Zhang | |
| 2015/0240802 | A1 * | 8/2015 | Guthrie | F04B 49/20 417/44.1 |
| 2016/0045400 | A1 | 2/2016 | Hudson | |
| 2016/0146649 | A1 | 5/2016 | Evans et al. | |
| 2016/0158437 | A1 * | 6/2016 | Biasi | F04B 43/0072 417/279 |
| 2016/0265519 | A1 | 9/2016 | Igarashi | |
| 2016/0312803 | A1 | 10/2016 | Cox et al. | |
| 2016/0319811 | A1 * | 11/2016 | Daniski | F04B 49/20 |
| 2018/0074525 | A1 | 3/2018 | Imai et al. | |
| 2018/0117241 | A1 | 5/2018 | Amborn et al. | |
| 2019/0070074 | A1 | 3/2019 | Biehl et al. | |
| 2019/0192760 | A1 | 6/2019 | Gorbachinsky | |
| 2019/0231956 | A1 | 8/2019 | Burbank et al. | |
| 2019/0326838 | A1 * | 10/2019 | Dion | F04B 41/02 |
| 2021/0180598 | A1 * | 6/2021 | Espelien | F25B 1/02 |

FOREIGN PATENT DOCUMENTS

| | | | |
|---|---|---|---|
| CN | 105487561 | A | 4/2016 |
| CN | 108159531 | A | 6/2018 |
| CN | 108355197 | A | 8/2018 |
| DE | 19525926 | C1 | 11/1996 |
| JP | WO2014/049656 | A1 | 8/2016 |
| JP | 6478815 | B2 | 3/2019 |
| WO | WO 2008/142741 | A1 | 11/2008 |
| WO | WO 2015/166051 | A1 | 11/2015 |
| WO | 2017106865 | A1 | 6/2017 |
| WO | WO 2019/085155 | A1 | 5/2019 |
| WO | WO 2019/141489 | A1 | 7/2019 |

OTHER PUBLICATIONS

S. Ozeri, et al. "Ultrasonic Air Bubble Detection Employing Signal Processing Techniques", IEEE ISIE 2006, Jul. 9-12, 2006. (6 Pages Total).

SONOTEC GmbH, SONOTEC Ultrasonic Solutions, Sonocheck ABD Air Bubble Sensors & Detectors Medical Devices for Medical applications with very high safety requirements, Sonockeck® ABD05 | ABD07 | ABD08—Air bubble sensors for use in medical technologies, Retrieved from Url: https://www.sonotecusa.com/products/non-invasive-fluid-monitoring/air-bubble-detection/sonocheck-abd-medtech/, (Accessed Jul. 27, 2020), (5 Pages Total).

* cited by examiner

400

402

FLOW RATE CONTROL FOR PUMP WITH FLOW SENSOR

INTRODUCTION

Aspects of the present disclosure generally relate to pumps and systems for controlling such pumps.

BACKGROUND

Fluid handling apparatuses such as positive displacement pumps are used in various environments to supply fluids at set rates. Positive displacement pumps are often used due to their precision and durability. For example, positive displacement pumps may operate unattended for continuous laboratory or manufacturing processes.

Although positive displacement pumps can operate for long periods of time without malfunctioning, errors can occur. For example, a positive displacement pump may utilize tubing that changes during operation of the positive displacement pump, for example, due to gradual wear changing tubing properties. The changes in the tubing may affect calibrated settings of the positive displacement pump.

Accordingly, there remains an unmet need in the related art for positive displacement pumps and systems and methods of control thereof that allow greater accuracy for constant flow.

SUMMARY

The following presents a simplified summary of one or more aspects of the present disclosure in order to provide a basic understanding of such aspects. This summary is not an extensive overview of all contemplated aspects, and is intended to neither identify key or critical elements of all aspects, nor delineate the scope of any or all aspects. Its purpose is to present some concepts of one or more aspects in a simplified form as a prelude to the more detailed description that is presented later.

In an aspect, the present disclosure provides a method of controlling a pump based on a downstream flow sensor to produce a constant flow rate. The method may include determining a targeted motor speed for a constant flow rate set point based on calibration information. The method may include determining a predicted movement time for a motor of the pump to change from a current motor speed to the targeted motor speed. The method may include determining a predicted wait time between a time that the pump will reach the targeted motor speed and a time that a flow rate detected by the downstream flow sensor will reach a flow rate corresponding to the targeted motor speed. The method may include determining a measurement time after the wait time where the pump keeps a constant speed and the flow rate detected by the downstream flow sensor is stable. The method may include controlling the positive displacement pump according to a control cycle based on the predicted movement time, the predicted wait time, and the measurement time. The method may include determining whether a measured flow rate during the measurement time is equal to the constant flow rate set point.

These and other aspects of the present disclosure will become more fully understood upon a review of the detailed description, which follows.

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known components are shown in block diagram form in order to avoid obscuring such concepts.

In an aspect, the disclosure provides for a positive displacement pump with a flow sensor and methods for controlling such a positive displacement pump to accurately dispense a fluid at a constant rate.

A flow sensor may provide a measurement of a flow rate through tubing downstream from the positive displacement pump. Conventional control techniques (e.g., proportional-integral-derivative (PID) controllers) may have difficulty in controlling a positive displacement pump to dispense fluid at a constant rate for several reasons. First, there may be latency between changes in the motor speed and changes in the detected flow rate. Second, a positive displacement pump may generate pulses in the flow rate. Third, a flow sensor may generate a noisy signal. Further, factors such as distance between the flow sensor and the pump head and relative elevation of fluid vessels and the pump head may affect flow rate. Given these factors, a flow rate signal may be noisy, which may cause a PID controller to constantly make adjustments and fail to converge at a constant flow rate. Accordingly, there is a need for alternative techniques for controlling a pump based on a flow sensor to dispense a fluid at a constant rate.

In an aspect, the present disclosure provides a control method that approaches a constant flow rate using flow control cycles. Each flow control cycle may account for a movement time ($T_{move}$) for a motor of the pump to change from a current motor speed to a targeted motor speed, a wait time ($T_{wait}$) between a time that the pump will reach the targeted motor speed to a time that a flow rate detected by the downstream flow sensor will reach a flow rate corresponding to the targeted motor speed, and a measurement time ($T_{measure}$) after the wait time where the pump keeps a constant speed and the flow rate detected by the downstream flow sensor is stable. Accordingly, a pump controller may determine a control cycle to cause the flow rate to converge to a targeted flow setpoint despite a noisy signal from flow sensor.

Figure 1A:
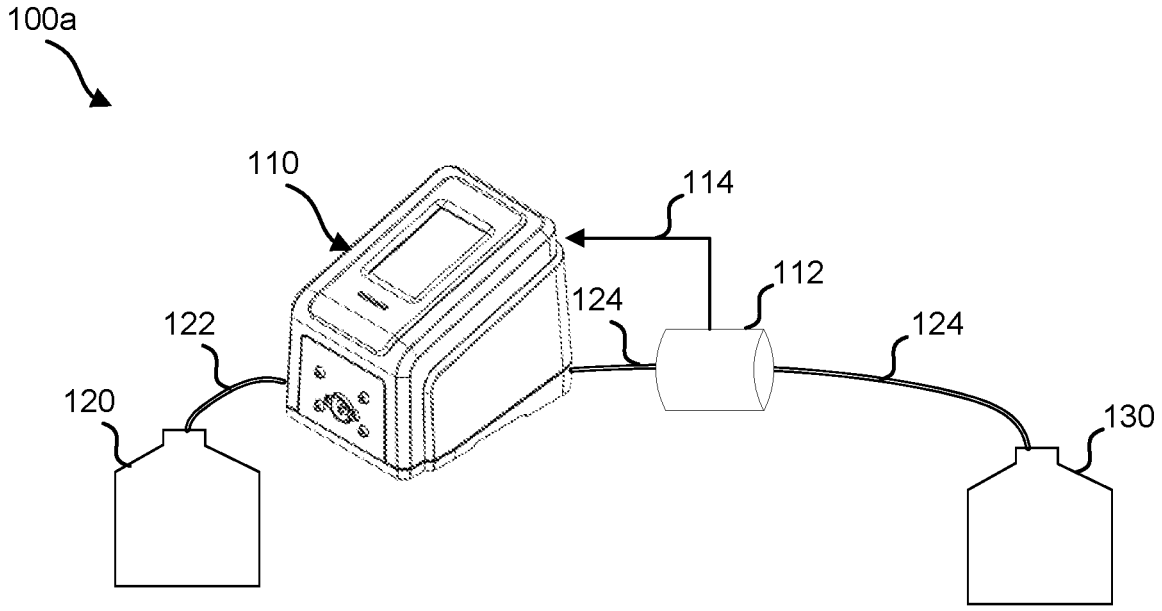
FIG. 1A is schematic diagram of an example operating environment for a positive displacement pump and flow sensor, according to an aspect of the disclosure.

FIG. 1A is a representative schematic diagram of a first example operating environment 100*a* for a positive displacement pump 110. The operating environment 100*a* may include the positive displacement pump 110, a fluid source 120, a fluid destination 130, and a flow sensor 112. The positive displacement pump 110 may pump fluid from the fluid source 120 to the fluid destination 130 via tubing, which may include an inlet tube 122 and an outlet tube 124. A flow sensor 112 may be located along the outlet tube 124. The flow sensor 112 may measure a flow rate in the outlet tube 124 and provide the flow rate to the positive displacement pump 110 via a connection 114. The connection 114 may be wired or wireless. For example, the connection 114 may include a wired connection carrying an analog signal (e.g., current, voltage, or frequency) or a digital signal (e.g., serial communication, RS232/485, ModBus, ProfiBus, EtherNet/IP, or ProfiNet). A wireless connection may include but is not limited to Bluetooth, Wifi, ZigBee, Zwave, etc. The positive displacement pump 110 may include a pump controller that controls a motor of the positive displacement pump 110 based on the flow rate. In particular, the positive displacement pump 110 may be controlled to accurately dispense the fluid to the fluid destination 130 at a constant flow rate.

Figure 1B:
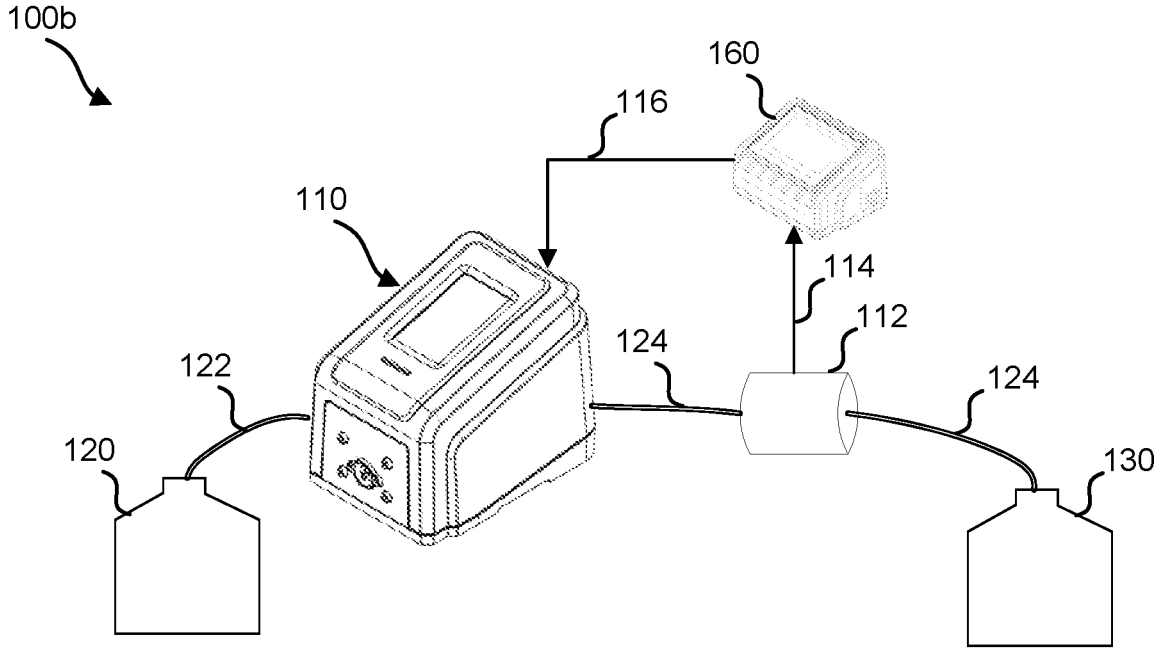
FIG. 1B is schematic diagram of an example operating environment for a positive displacement pump, external pump controller, and flow sensor, according to an aspect of the disclosure.

FIG. 1B is a representative schematic diagram of a second operating environment 100*b* for a positive displacement pump 110. The operating environment 100*b* may include the positive displacement pump 110, an external pump controller 160, the fluid source 120, the fluid destination 130, and the flow sensor 112. The positive displacement pump 110 may pump fluid from the fluid source 120 to the fluid destination 130 via tubing, which may include the inlet tube 122 and the outlet tube 124. The flow sensor 112 may be located along the outlet tube 124. The flow sensor 112 may measure a flow rate in the outlet tube 124 and provide the flow rate to the pump controller 160 via the connection 114. The connection 114 may be wired or wireless. For example, the connection 114 may include a serial bus, Ethernet, or a Wi-Fi connection. The pump controller 160 may control a motor of the positive displacement pump 110 based on the flow rate. For example, the flow controller may transmit a control signal via a connection 116, which may also be wired or wireless. In particular, the positive displacement pump 110 may be controlled to accurately dispense the fluid to the fluid destination 130 at a constant flow rate.

The positive displacement pump 110 may be a positive displacement pump including the communications hardware (e.g., network interface) and software described herein for providing control of the positive displacement pump 110. As discussed above, the positive displacement pump 110 may be include a pump controller or may be controlled by an external pump controller 160.

Figure 2:
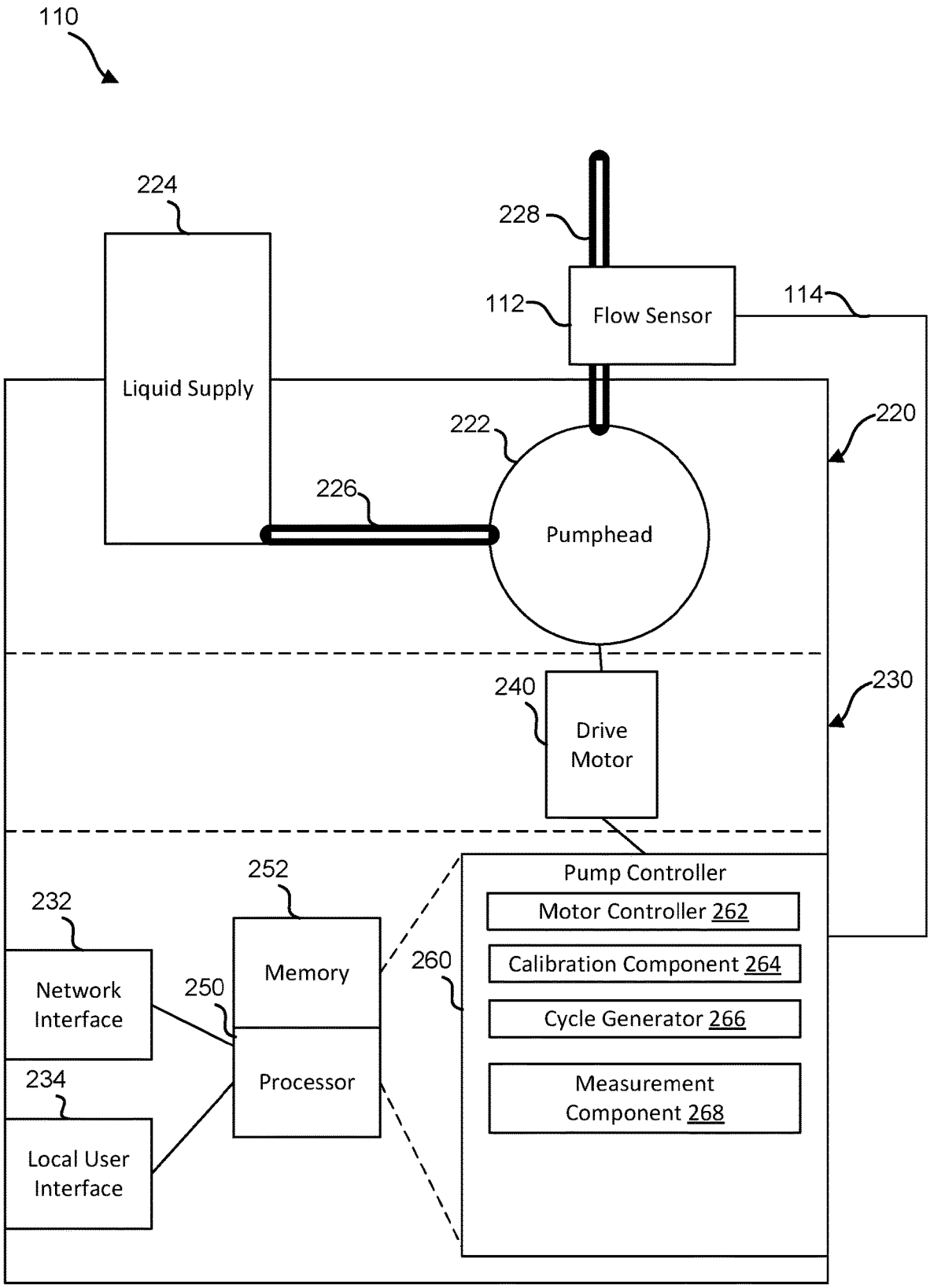
FIG. 2 is schematic diagram of an example positive displacement pump and flow sensor, according to an aspect of the disclosure.

FIG. 2 is a representative schematic diagram of an example positive displacement pump 110 usable in accordance with aspects of the present disclosure. The term "positive displacement pump" as used herein describes a category of fluid pumps that trap a fixed amount of fluid and force the trapped fluid to a discharge pipe. Positive displacement pumps are conventionally used in processes that require precise measurement or dosing of fluid. Positive displacement pumps may be driven by an electric motor under the control of a controller (e.g., electronic control unit (ECU) and/or other processor) that rotates the motor shaft at a desired speed. In an aspect, a positive displacement pump may include a detachable pump head that includes a casing and fluid contacting components of the positive displacement pump. The pump head may be driven by the motor via a magnetic coupling, for example. The positive displacement pump may be fitted with a different pump head, depending on the desired operation. For example, in an aspect, a positive displacement pump may include a housing including the drive motor, controller, and user interfaces, and a detachable pump head may be fitted in or on the housing. The selection of different pump heads may configure the positive displacement pump 110 as, for example, one of a peristaltic pump, gear pump, or diaphragm pump.

The positive displacement pump 110 may include a wet end 220 and a case 230. The wet end 220 may include fluid handling components including a pump head 222, a liquid supply 224, an inlet tube 226, and an outlet tube 228. The wet end 220 may be detachable from the case 230 to allow replacement or substitution of the wet end 220. For example, different pump heads 222 may be selected for use in pumping different fluids.

The pump head 222 may include a mechanism for pumping fluid. In an aspect, the positive displacement pump 110 may use a pump head that allows precise monitoring of the fluid being pumped (e.g., volume pumped). Example pump heads may include a peristaltic pump head, a quaternary diaphragm pump head, and/or a gear pump head. The pump head 222 may be connected to a liquid supply 224 via an inlet tube 226. The pump head 222 may pump the fluid to the outlet tube 228. In an aspect, for example, using a peristaltic pump, the inlet tube 226 and the outlet tube 228 may be or include a continuous tube extending through the pump head 222.

The case 230 may include electronic components of the positive displacement pump 110. For example, the case 230 may include a network interface 232, a local user interface 234, a drive motor 240, a processor 250, and a memory 252. Further, the memory 252 may store instructions executable by the processor 250 for implementing a pump controller 260, which may include a motor controller 262, a calibration component 264, a cycle generator 266, and a measurement component 268.

The network interface 232 may include a wired or wireless network interface for transmitting and receiving data packets. In an aspect, the network interface 232, for example, may utilize Internet Protocol (IP) packets that may carry commands, parameters, or data. The network interface 232 may forward commands to the processor 250 for processing by the pump controller 260. Conversely, the network interface 232 may receive data generated by the pump controller 260 from the processor 250 and transmit the data, for example, to an external pump controller 160.

The local user interface 234 may include any suitable controls provided on the positive displacement pump 110 for controlling the positive displacement pump 110. In an aspect, the local user interface 234 may include a display screen that presents menus for selecting commands (e.g., set target volume). In another aspect, the local user interface 234 may include dedicated buttons and/or other selection features that perform specific commands. For example, the local user interface 234 may include a button for selection to start/stop pumping. The local user interface 234 may generate commands to the processor 250 for processing by the pump controller 260. In some implementations, the positive displacement pump 110 may operate in a remote mode in which the local user interface 234 is at least partially disabled to prevent local input.

The drive motor 240 may be or include an electric motor that provides a force for pumping the fluid. In an aspect, the drive motor 240 may be magnetically coupled to the pump head 222 to drive the pump head 222. The drive motor 240 may be controlled by the pump controller 260. For example, the pump controller 260 may generate a control signal indicating a speed and direction of the drive motor 240 based on received commands.

The processor 250 may include one or more processors for executing instructions. An example of processor 250 may include, but is not limited to, any suitable processor specially programmed as described herein, including a controller, microcontroller, application specific integrated circuit (ASIC), field programmable gate array (FPGA), system on chip (SoC), or other programmable logic or state machine. The processor 250 may include other processing components, such as an arithmetic logic unit (ALU), registers, and a control unit. The processor 250 may include multiple cores and may be able to process different sets of instructions and/or data concurrently using the multiple cores to execute multiple threads, for example.

Memory 252 may be configured for storing data and/or computer-executable instructions defining and/or associated with the pump controller 260, and processor 250 may execute such instructions with regard to operation of the pump controller 260. Memory 252 may represent one or more hardware memory devices accessible to processor 250. An example of memory 252 can include, but is not limited to, a type of memory usable by a computer, such as random access memory (RAM), read only memory (ROM), tapes, magnetic discs, optical discs, volatile memory, non-volatile memory, and any combination thereof. Memory 252 may store local versions of a pump controller application being executed by processor 250, for example.

The pump controller 260 may control operation of the positive displacement pump 110 based on commands received from either the network interface 232 or the local user interface 234, for example. The pump controller 260 may include a motor controller 262 for controlling operation of the drive motor 240, a calibration component 264 for performing a calibration operation to determine a mapping between pump speed and flow rate, a cycle generator 266 for determining timing parameters of a control cycle, and a measurement component 268 for performing measurements of flow rate and/or pumped volume.

Figure 3:
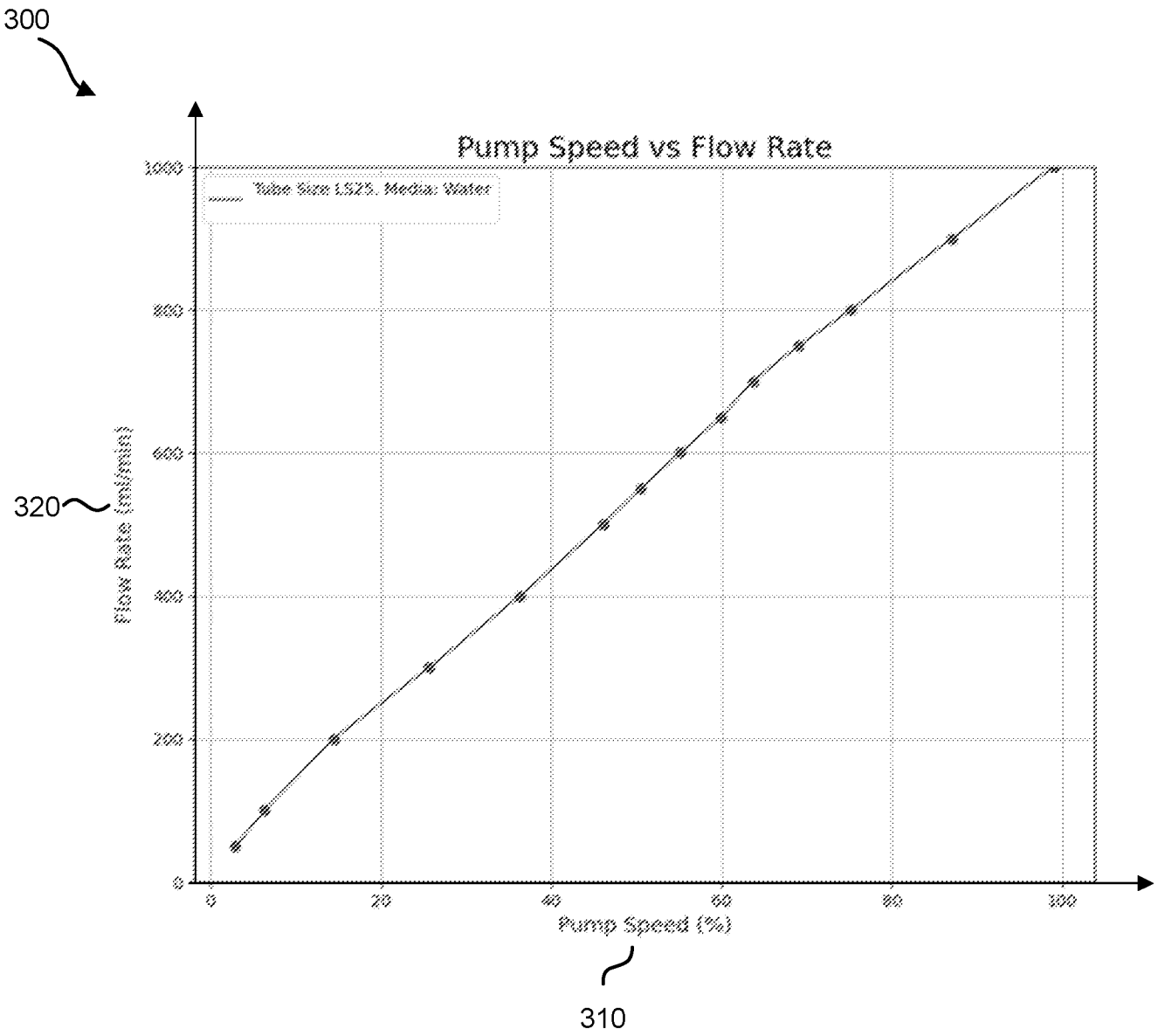
FIG. 3 is an example of a mapping between pump speed and flow rate, according to an aspect of the disclosure.

FIG. 3 is a diagram of an example mapping 300 from a pump speed 310 to a flow rate 320. The pump speed 310 may be expressed as a percentage of a maximum pump speed. In some implementations, the pump speed 310 may be expressed as a related value such as revolutions per minute (RPM), control signal input value, or input voltage. The flow rate may be expressed as a volume of fluid per unit of time (e.g., milliliters (mL)/minute (min)). The mapping 300 may be generated by the calibration component 264 by performing a calibration procedure. For example, the calibration procedure may include setting the pump speed at various levels and measuring a constant flow rate at the pump speed. The mapping 300 may be expected to be generally linear with some variance due to tubing characteristics (e.g., diameter, material, flexibility) and fluid characteristics (e.g., viscosity). Values that are not specifically calibrated may be interpolated from the measured values. In an aspect, the tubing characteristics and/or fluid characteristics may change over time. The control techniques disclosed herein may provide adaptation to the changing characteristics in order to improve accuracy and precision of a total volume of fluid pumped.

Figure 4A:
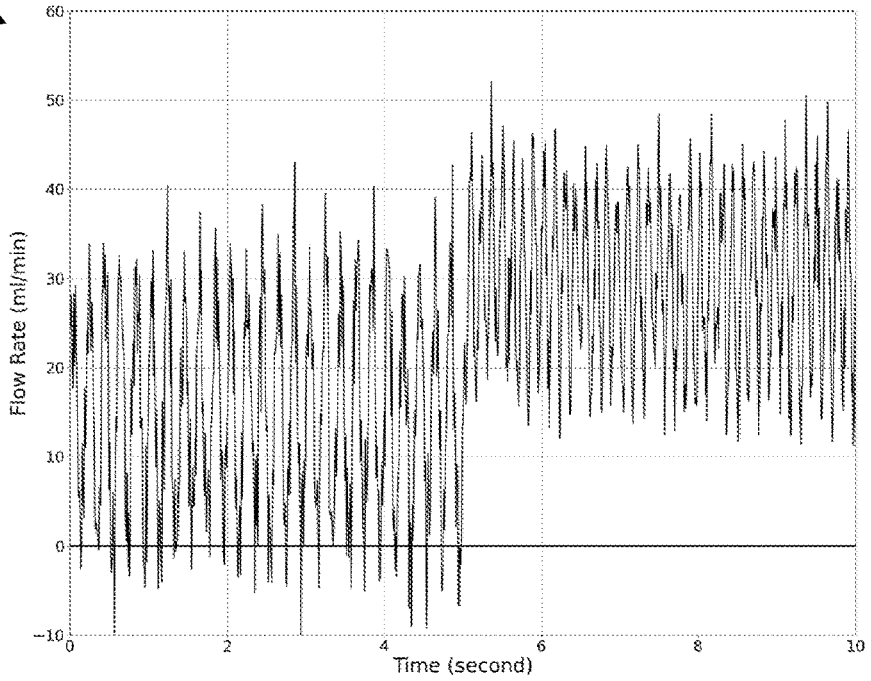
FIG. 4A is a first chart of a first example signal from an example flow rate sensor, according to an aspect of the disclosure.
Figure 4B:
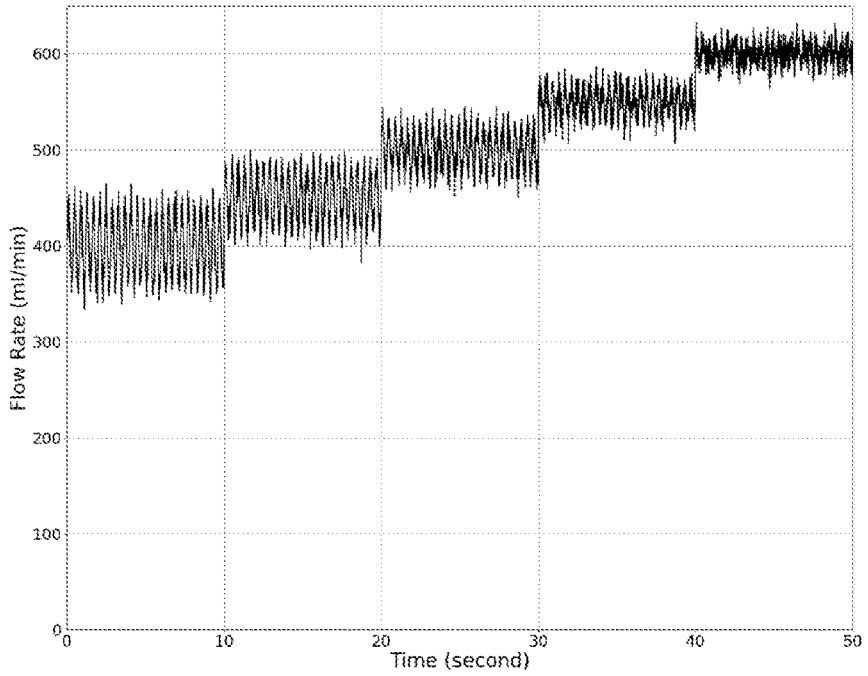
FIG. 4B is a second chart of a second example signal from the example flow rate sensor, according to an aspect of the disclosure.

FIG. 4A is a chart of a first example signal 400 from a flow meter measuring a flow rate in an outlet tube of a peristaltic pump during a time period. Due to the pulsation of the pump, the example signal is noisy. During a first part of the chart (from 0 seconds to 5 seconds), although the flow rate average is 15 ml/min, the instantaneous values of the signal move between −10 ml/min and 40 ml/min. Similarly, from 5 seconds to 10 seconds, the flow rate average is about 30 ml/min but the instantaneous values vary from 10 to 50 ml/min. FIG. 4B is a chart of a second example signal 402 from a flow meter measuring a flow rate in an outlet tube of a peristaltic pump operating at a greater flow rate during a time period. Although during each 10 second period the pump was run at a constant speed and the average flow rate was constant, the instantaneous values are noisy. Such noise may prevent conventional feedback mechanisms from converging to a constant flow rate.

Figure 5:
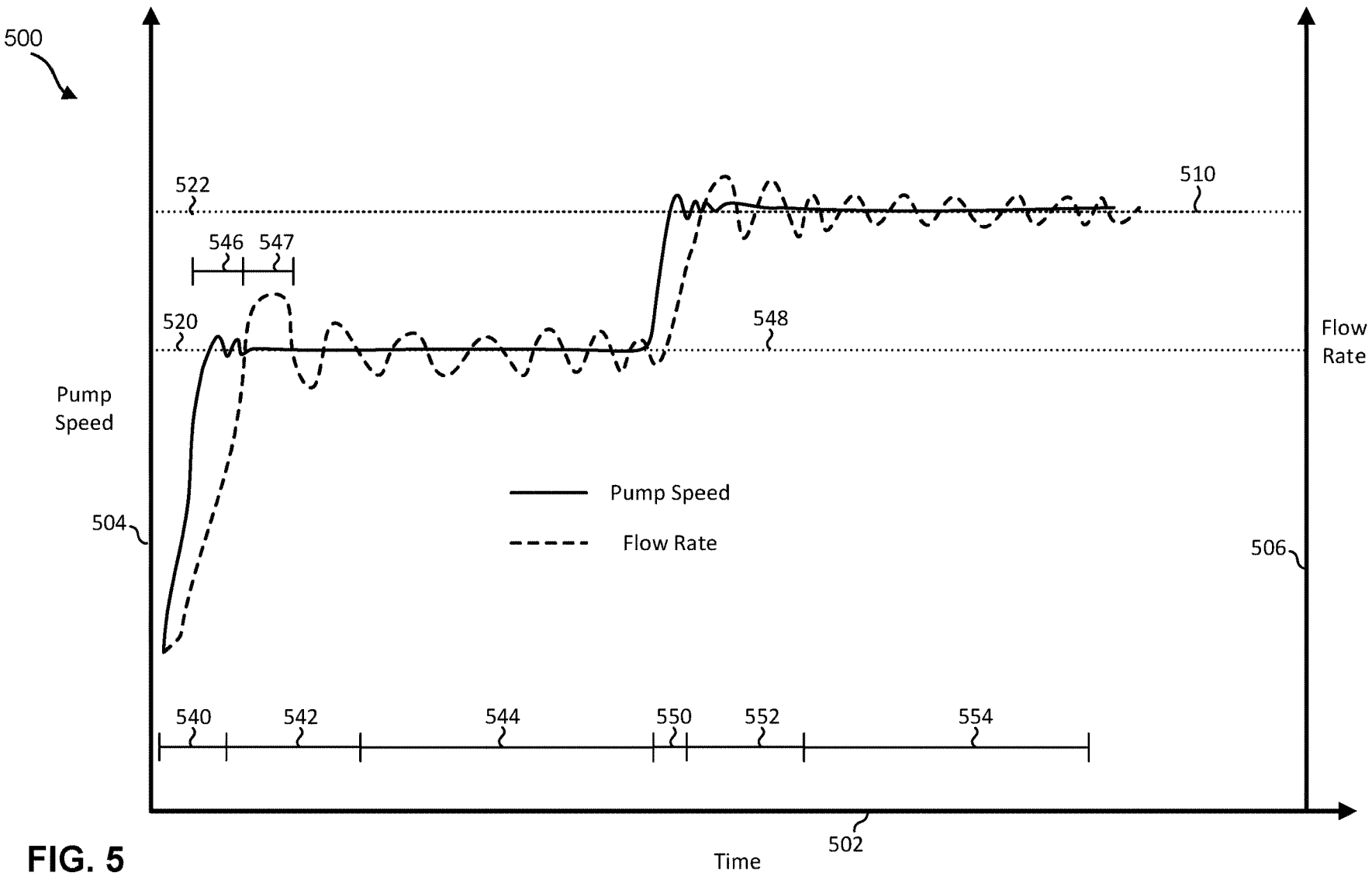
FIG. 5 is a diagram of example control cycles to achieve a constant flow rate, according to an aspect of the disclosure.

FIG. 5 is a diagram 500 of an example pump speed 504 and flow rate 506 over time 502 during two control cycles. For example, the pump 110 may be controlled according to a series of control cycles to produce a target flow rate 510.

In order to achieve the target flow rate 510, the pump controller 160 may set an initial pump speed 520 for a first control cycle based on calibration information such as the mapping 300. For instance, the pump controller 160 may select the initial pump speed 520 that maps to the target flow rate 510. During a movement time 540, the pump speed 504 may increase toward the initial pump speed 520. The pump speed 504 may overshoot the initial pump speed 520, but the motor controller 262 commands the pump speed 504 to converge to the initial pump speed 520 during an overshoot time 546. The flow rate 506 may experience latency 547 in responding to the change in the pump speed 504. During a wait time 542, after the pump speed 504 reaches the initial pump speed 520, the flow rate 506 may initially overshoot a first flow rate corresponding to the initial pump speed 520 during the latency 547. Because the pump is operating at a constant speed during the wait time 542, an average of the flow rate 506 may converge to the first flow rate 548 corresponding to the initial pump speed 520. Further signal processing may be performed to determine the average flow rate 506. For example, the measurement component 268 may determine one or more of: a mean of the flow rate signal, a standard deviation, local minimums and maximums, a pulsation frequency, a pulsation duration, sensor noise, a finite impulsive response (FIR) filter length, and flow rate frequency response. In an aspect, the average flow rate 506 may be a mean flow rate based on a low-pass FIR filter and an average filter during the measurement subcycle. Accordingly, the average flow rate may be measured during a measurement time 544 to determine whether the first flow rate matches the target flow rate 510.

The measured flow rate may be a function of the pump speed, fixed parameters, and variable parameters. The fixed parameters may be based on a system configuration and not change during system operation. Example fixed parameters include pump type (e.g., peristaltic, diaphragm, etc.), type of motor, minimum/max pump speed, size of pump, tubing size, tubing material, tubing thickness, relative height differences from the pump head and source fluid vessel, and distance between the pump head and location of the flow sensor. Variable parameters may change during operation. Example variable parameters include fluid characteristics such as viscosity and density, environmental variables such as temperature, humidity, and barometric pressures, pump energy consumption, and tubing degradation.

In the illustrated example, the first flow rate may be lower than the target flow rate 510, for example, because of wear of the tubing resulting in lower pumping efficiency since the calibration.

The pump 110 may execute a second control cycle to correct a deviation between the first flow rate and the target flow rate 510. The pump controller 160 may select a second pump speed 522 based on the difference between the first flow rate and the target flow rate 510. Because the original calibration information may not be accurate, the calibration information (e.g., flow rate function) may be updated based on the measurements during the measurement sub-cycle prior to determining the second pump speed 522. The pump controller 160 may determine a movement time 550 based on the difference between the first pump speed 520 and the second pump speed 522. The pump controller 160 may determine the wait time 552 based on characteristics of the pump, the tubing size, the fluid characteristics, and the sampling rate of the flow sensor. The pump controller 160 may determine the measurement time 554 based on a target accuracy, the current pump speed, a characteristic of the pump motor, a tubing size, a fluid characteristic, a sampling rate of the flow sensor, a standard deviation, a number of pump head rollers, a frequency, and a noise level. In an aspect, the target accuracy may depend on an operating mode. For example, a searching mode may be applicable when changing to the target constant flow rate, and a tracking mode may be applicable when the measured flow rate is within a threshold deviation of the target constant flow rate. The tracking mode may have a greater target accuracy than the searching mode. Accordingly, the measurement time 554 may be longer for the tracking mode than for the searching mode.

Figure 6:
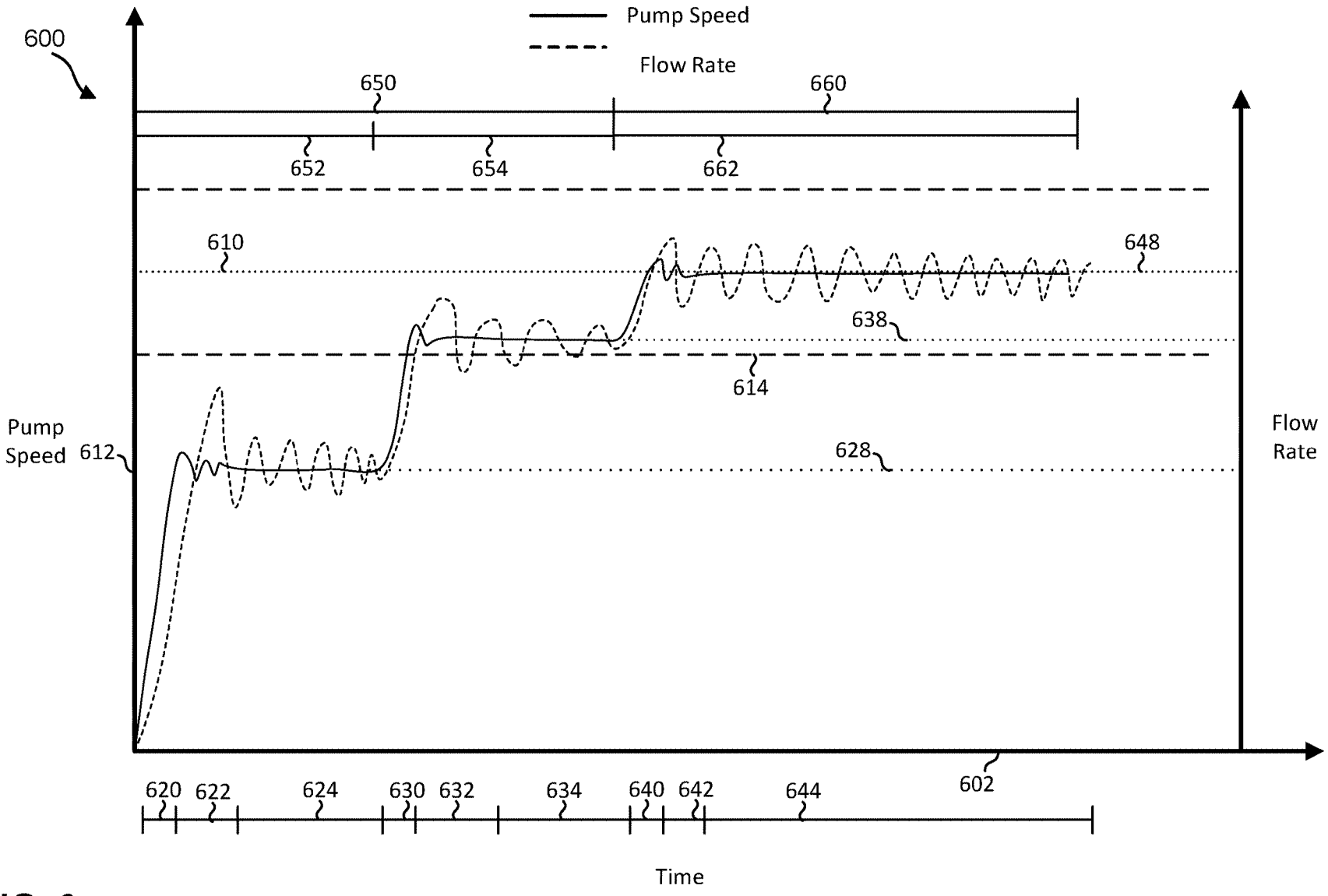
FIG. 6 is a diagram of example control cycles in different operating modes, according to an aspect of the disclosure.

FIG. 6 is a diagram 600 of multiple control cycles in a searching mode 650 and a tracking mode 660 over time 602. For example, the pump 110 may be set to produce a target flow rate 610. The pump 110 may operate in the searching mode for a first control cycle 652 and a second control cycle 654 to reach the target flow rate 610. The pump 110 may then enter the tracking mode 660 for a next control cycle to maintain a constant flow rate.

During the first control cycle 652, the pump controller 160 may select a first pump speed 612 based on the calibration mapping 300. The pump controller 160 may determine the movement time 620, wait time 622, and measurement time 624. At the end of the measurement time 624, the pump controller 160 may determine the average flow rate 628 during the measurement time 624. The pump controller 160 may determine that the average flow rate 628 is less than the target flow rate 610 and less than a threshold flow rate 614. Accordingly, the pump controller 160 may remain in the searching mode 650 for the second control cycle 654. The pump controller 160 may determine the movement time 630, the wait time 632, and the measurement time 634 for the second control cycle 654. At the end of the measurement time 634, the pump controller 160 may determine the average flow rate 638. In this example, the average flow rate 638 may be less than the target flow rate 610, but greater than the threshold flow rate 614. Accordingly, the pump controller 160 may use the tracking mode 660 for a third control cycle 662. The pump controller 160 may determine the movement time 640 and the wait time 642, which may be shorter during the tracking mode 660 due to the smaller change in pump speed. The pump controller 160 may also determine the measurement time 644, which may be longer during the tracking mode 660 to improve accuracy. The pump controller 160 may measure the flow rate 648 at the end of the measurement time 644. If the flow rate 648 is equal to the target flow rate 610, the pump controller 160 may maintain the current pump speed; otherwise, the pump controller may start another control cycle to improve the accuracy of the flow rate.

Figure 7:
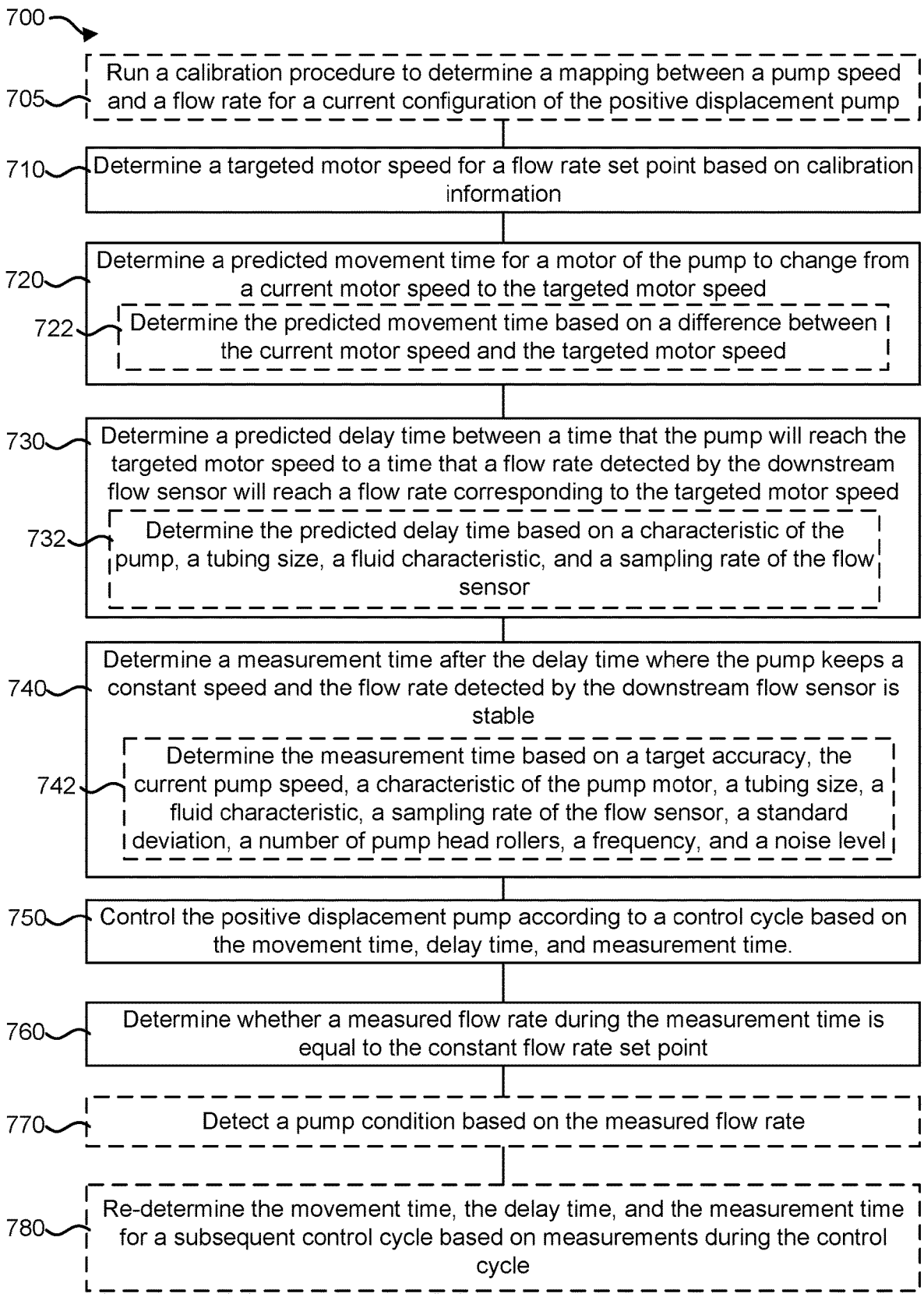
FIG. 7 is a flow diagram showing an example method of controlling a positive displacement pump, according to an aspect of the disclosure.

FIG. 7 is a flow diagram showing an example method 700 of controlling a positive displacement pump, in accordance with aspects of the present disclosure. The method 700 may be performed by the pump controller 160 of FIG. 2, for example. Optional blocks are shown with dashed lines.

In block 705, the method 700 may optionally include running a calibration procedure to determine a mapping between a pump speed and a flow rate for a current configuration of the positive displacement pump, a tubing size, and a fluid characteristic. In an aspect, for example, as shown in FIG. 3, the calibration procedure may determine the mapping 300 including flow rate 320 at various pump speeds 310. During the calibration procedure, the flow rate 320 may be measured when the pump operates at a constant speed such that the flow rate signal has stabilized and is less noisy. Finally, the calibration parameters are saved in the pump's nonvolatile memory.

In block 710, the method 700 may include determining a targeted motor speed for a flow rate set point based on a flow rate function. For example, the calibration component 264 may determine the targeted motor speed (e.g., pump speed 520 or 612) for a flow rate set point (e.g., target flow rate 510, 610) based on the mapping 300. The flow rate function may be based on the calibration procedure in block 705 or on measurements during a previous control cycle.

In block 720, the method 700 may include determining a predicted movement time of the pump movement sub-cycle for a motor of the pump to change from a current motor speed to the targeted motor speed. In an aspect, for example, the motor controller 262 may determine the predicted movement time 540, 620 for the drive motor 240 of the pump 110 to change from a current motor speed (e.g., 0) to the targeted motor speed (e.g., pump speed 520 or 612). The predicted movement time 540, 620 may be the duration of the pump movement sub-cycle. For example, in sub-block 722, the motor controller 262 may determine the predicted movement time based on a difference between the current motor speed and the targeted motor speed. For instance, where the pump has a linear motion profile, the motor controller 262 may divide the difference by a pump acceleration rate. If the pump uses a specific motion profile, the predicted movement time may be based on the specific motion profile as well as the difference between the current motor speed and the targeted motor speed.

In block 730, the method 700 may include determining a predicted wait time of the wait sub-cycle between a time that the pump will reach the targeted motor speed and a time that a flow rate detected by the downstream flow sensor will reach a flow rate corresponding to the targeted motor speed. In an aspect, for example, the cycle generator 266 may determine the predicted wait time 542, 622 between the time that the pump 110 will reach the targeted motor speed and a time that a flow rate detected by the downstream flow sensor 112 will reach a flow rate corresponding to the targeted motor speed. For example, in sub-block 732, the cycle generator 266 may determine the predicted wait time 542, 622 based on a characteristic of the pump and a sensor delay time. The overshoot time may depend on the characteristic of the pump, a tubing size and fluid characteristic. The overshoot time and the sensor delay time may be determined during the calibration procedure in block 705. In some implementations, the predicted wait time 542, 622 ($T_{wait}$) may be determined according to the formula:

$$T_{Wait}=(\text{Overshoot Time}+\text{Sensor Delay Time})\times r$$

where r is a selected number of cycles (e.g., between 1 and 5).

In block 740, the method 700 may include determining a measurement time of the measurement sub-cycle after the wait time where the pump keeps a constant speed and the flow rate detected by the downstream flow sensor is stable. For example, the measurement component 268 may determine the measurement time 544, 624 after the wait time 542, 622 where the pump 110 keeps a constant speed and the flow rate 548, 628 detected by the downstream flow sensor 112 is stable. For example, in sub-block 742, the measurement component 268 may determine the measurement time based on a target accuracy. The target accuracy may be selected by an operator and may be less than 20%. In some implementations, the target accuracy may be based on an operating mode being one of the searching mode 650 and the tracking mode 660, as discussed above. In some implementations, the measurement time may be based on fixed parameters and variable parameters of the system, which may be determined during calibration and/or a previous control cycle. Accordingly, in some implementations, the measurement time may be based on a calibrated factor, the operating mode, and the current pump speed.

In block 750, the method 700 may include controlling the positive displacement pump according to consecutive control cycles, each control cycle including a pump movement sub-cycle, a wait sub-cycle, and a measurement sub-cycle. For example, the pump controller 160 and/or motor controller 262 may control the positive displacement pump 110 according to a control cycle based on the movement time, wait time, and measurement time. For instance, the motor controller 262 may convert the targeted motor speed to a control signal (e.g., a pulse width modulated signal) for a duration of the movement time, wait time, and measurement time. The control signal may be provided to the drive motor 240.

In block 760, the method 700 may include determining a measured flow rate during the measurement sub-cycle. For example, the measurement component 268 may perform a flow rate measurement over the measurement time to determine a measured flow rate 548, 628. For instance, the measurement component 268 may include a signal processor that samples the flow rate signal and determines an average flow rate.

For example, the pump controller 160 may compare the measured flow rate 548, 628 to the flow rate set point (e.g., target flow rate 510, 610). If the measured flow rate is different than the constant flow rate set point, the pump controller may proceed to block 770 to start another control cycle. If the measured flow rate is equal to the flow rate set point, the pump controller may continue to periodically measure the flow rate.

In block 770, the method 700 may include detecting a pump condition based on the measured flow rate. For example, the pump condition may be one of: a leak, a wrong flow direction, an open pump head, an incorrect tubing size, a tubing degradation, or a tubing obstruction. The pump 110 may generate an alert in response to detecting a pump condition. For example, the pump 110 may present the alert on the local user interface 234 or send a message with the alert via the network interface 232.

A leak condition may indicate that fluid is leaking from the tubing. A leak condition may be detected in response to detecting a decrease in the flow rate when the pump runs at a constant speed. A change in pump current or energy of the pulsation frequency may also be indicative of a leak. The pump may be stopped in response to the leak condition.

A wrong flow direction condition may be detected in response to the flow rate not changing after the duration of the wait sub-cycle. A wrong flow direction condition may also include fluid not being primed, an open pump head, a flow sensor installed in the wrong direction, flow sensor power loss or damage, or fluid pumping in the wrong direction. The pump may be stopped in response to a wrong flow direction condition.

An open pump head condition may be detected based on the flow rate being zero when the pump speed is greater than zero.

An incorrect tubing size condition may be detected based on a difference between an expected flow rate change based on the flow rate function and a measured flow rate change.

A tubing degradation condition may be detected based on a motor current and flow rate. For example, a decrease in motor current and/or flow rate for a set motor speed may indicate the tubing degradation condition. The method may include stopping the pump in response to the detection of the tubing degradation condition.

A tubing high pressure condition may be detected in response to an increasing pump speed, an increasing pump current, and a difference between an expected flow rate and a measured flow rate being greater than a threshold.

A tubing obstruction condition may be detected based on a pump motion profile, a difference between a local minimum flow rate and a local maximum flow rate, and a pulsation duration.

Detecting the pump condition may include counting a number of control cycles to reach the flow rate set point from the measured flow rate.

In block 780, the method 700 may optionally include updating the flow rate function based on measurements during the consecutive control cycles. For example, the measurements during the control cycles may include the average flow rate during the measurement time as well as an actual movement time and an actual wait time. Accordingly, the flow rate function (e.g., mapping 300) may be updated with new flow rate values to be used for subsequent control cycles.

Figure 8:
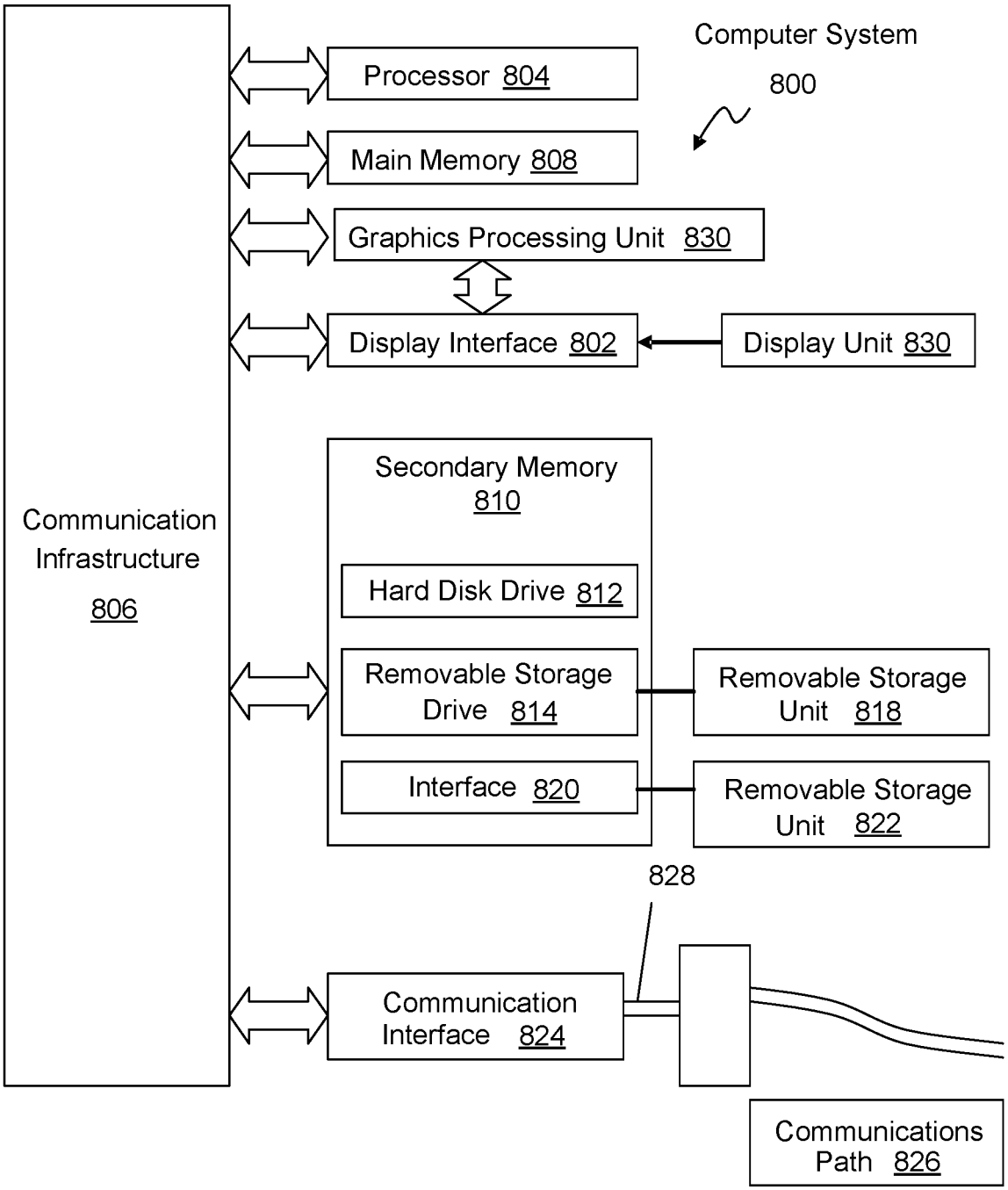
FIG. 8 presents an exemplary system diagram of various hardware components and other features, for use in accordance with aspects of the present disclosure.

Aspects of the present disclosure may be implemented using hardware, software, or a combination thereof and may be implemented in one or more computer systems or other processing systems. In one aspect, the disclosure is directed toward one or more computer systems capable of carrying out the functionality described herein. FIG. 8 presents an example system diagram of various hardware components and other features that may be used in accordance with aspects of the present disclosure. Aspects of the present disclosure may be implemented using hardware, software, or a combination thereof and may be implemented in one or more computer systems or other processing systems. In one example variation, aspects of the disclosure are directed toward one or more computer systems capable of carrying out the functionality described herein. An example of such a computer system 800 is shown in FIG. 8.

Computer system 800 includes one or more processors, such as processor 804. The processor 804 is connected to a communication infrastructure 806 (e.g., a communications bus, cross-over bar, or network). Various software aspects are described in terms of this example computer system. After reading this description, it will become apparent to a person skilled in the relevant art(s) how to implement aspects of the disclosure using other computer systems and/or architectures.

Computer system 800 may include a display interface 802 that forwards graphics, text, and other data from the communication infrastructure 806 (or from a frame buffer not shown) for display on a display unit 830. Computer system 800 also includes a main memory 808, preferably random access memory (RAM), and may also include a secondary memory 810. The secondary memory 810 may include nonvolatile memory, for example, a hard disk drive 812, flash memory and/or a removable storage drive 814, representing a floppy disk drive, a magnetic tape drive, an optical disk drive, etc. The removable storage drive 814 reads from and/or writes to a removable storage unit 818 in a well-known manner. Removable storage unit 818, represents a USB memory drive, SD card, floppy disk, magnetic tape, optical disk, etc., which is read by and written to removable storage drive 814. As will be appreciated, the removable storage unit 818 includes a computer usable storage medium having stored therein computer software and/or data.

In alternative aspects, secondary memory 810 may include other similar devices for allowing computer programs or other instructions to be loaded into computer system 800. Such devices may include, for example, a removable storage unit 822 and an interface 820. Examples of such may include a program cartridge and cartridge interface (such as that found in video game devices), a removable memory chip (such as an erasable programmable read only memory (EPROM), or programmable read only memory (PROM)) and associated socket, and other removable storage units 822 and interfaces 820, which allow software and data to be transferred from the removable storage unit 822 to computer system 800.

Computer system 800 may also include a communications interface 824. Communications interface 824 allows software and data to be transferred between computer system 800 and external devices. Examples of communications interface 824 may include a modem, a network interface (such as an Ethernet card), a communications port, a Personal Computer Memory Card International Association (PCMCIA) slot and card, etc. Software and data transferred via communications interface 824 are in the form of signals 828, which may be electronic, electromagnetic, optical or other signals capable of being received by communications interface 824. These signals 828 are provided to communications interface 824 via a communications path (e.g., channel) 826. This path 826 carries signals 828 and may be implemented using wire or cable, fiber optics, a telephone line, a cellular link, a radio frequency (RF) link and/or other communications channels. In this document, the terms "computer program medium" and "computer usable medium" are used to refer generally to media such as a removable storage drive 814, a hard disk installed in hard disk drive 812, and signals 828. These computer program products provide software to the computer system 800. Aspects of the disclosure are directed to such computer program products.

Computer programs (also referred to as computer control logic) are stored in main memory 808 and/or secondary memory 810. Computer programs may also be received via communications interface 824. Such computer programs, when executed, enable the computer system 800 to perform various features in accordance with aspects of the present disclosure, as discussed herein. In particular, the computer programs, when executed, enable the processor 804 to perform such features. Accordingly, such computer programs represent controllers of the computer system 800.

In variations where aspects of the disclosure are implemented using software, the software may be stored in a computer program product and loaded into computer system 800 using removable storage drive 814, hard disk drive 812, or communications interface 820. The control logic (software), when executed by the processor 804, causes the processor 804 to perform the functions in accordance with aspects of the disclosure as described herein. In another variation, aspects are implemented primarily in hardware using, for example, hardware components, such as application specific integrated circuits (ASICs). Implementation of the hardware state machine so as to perform the functions described herein will be apparent to persons skilled in the relevant art(s).

In yet another example variation, aspects of the disclosure are implemented using a combination of both hardware and software.

Figure 9:
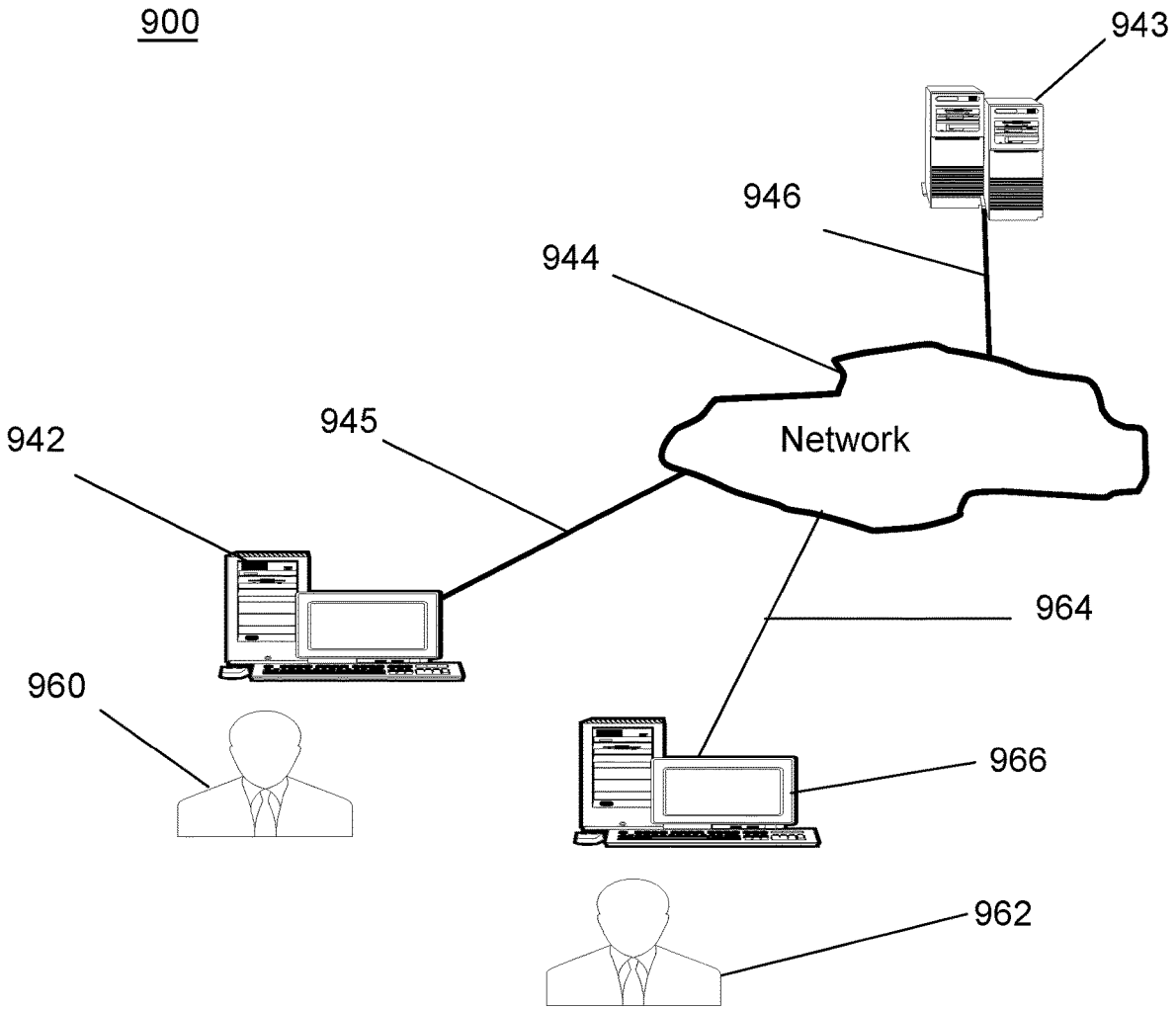
FIG. 9 is a block diagram of various exemplary system components, for use in accordance with aspects of the present disclosure.

FIG. 9 is a block diagram of various example system components (e.g., on a network) that may be used in accordance with aspects of the present disclosure. The system 900 may include one or more accessors 960, 962 (also referred to interchangeably herein as one or more "users") and one or more terminals 942, 966. In one aspect, data for use in accordance with aspects of the present disclosure may, for example, be input and/or accessed by accessors 960, 962 via terminals 942, 966, such as personal computers (PCs), minicomputers, mainframe computers, microcomputers, telephonic devices, or wireless devices, such as personal digital assistants ("PDAs") or a hand-held wireless devices coupled to a server 943, such as a PC, minicomputer, mainframe computer, microcomputer, or other device having a processor and a repository for data and/or connection to a repository for data, via, for example, a network 944, such as the Internet or an intranet, and couplings 945, 946, 964. The couplings 945, 946, 964 include, for example, wired, wireless, or fiber optic links. In another example variation, the method and system in accordance with aspects of the present disclosure operate in a stand-alone environment, such as on a single terminal.

The aspects of the disclosure discussed herein may also be described and implemented in the context of computer-readable storage medium storing computer-executable instructions. Computer-readable storage media includes computer storage media and communication media. For example, flash memory drives, digital versatile discs (DVDs), compact discs (CDs), floppy disks, and tape cassettes. Computer-readable storage media may include volatile and nonvolatile, removable and non-removable media implemented in any method or technology for storage of information such as computer readable instructions, data structures, modules or other data.

This written description uses examples to disclose aspects of the present disclosure, including the preferred embodiments, and also to enable any person skilled in the art to practice the aspects thereof, including making and using any devices or systems and performing any incorporated methods. The patentable scope of these aspects is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Aspects from the various embodiments described, as well as other known equivalents for each such aspect, can be mixed and matched by one of ordinary skill in the art to construct additional embodiments and techniques in accordance with principles of this application.

The invention claimed is:

1. A method of controlling a pump based on a pump speed and a downstream flow sensor, comprising:

determining a targeted motor speed for a flow rate set point based on a flow rate function;

controlling the pump according to consecutive control cycles, wherein each control cycle includes a pump movement sub-cycle, a wait sub-cycle, and a measurement sub-cycle;

determining a measured flow rate during the measurement sub-cycle, wherein a subsequent control cycle of the consecutive control cycles is based on the measured flow rate;

determining a predicted movement time of the pump movement sub-cycle for a motor of the pump to change from a current motor speed to the targeted motor speed;

determining a predicted wait time of the wait sub-cycle between a time that the pump will reach the targeted motor speed and a time that a flow rate detected by the downstream flow sensor will reach a flow rate corresponding to the targeted motor speed; and determining a measurement time of the measurement sub-cycle after the predicted wait time where the pump keeps a constant speed and the flow rate detected by the downstream flow sensor is stable.

2. The method of claim 1, wherein the predicted movement time is based on at least a difference between the current motor speed and the targeted motor speed.

3. The method of claim 1, wherein the predicted wait time is based on at least an overshoot time and a sensor delay time.

4. The method of claim 1, wherein the measurement time is based on a target accuracy and a difference between the measured flow rate and the flow rate set point.

5. The method of claim 4, wherein the measurement time is based on a searching mode when the difference between the measured flow rate and the flow rate set point is greater than a threshold and based on a tracking mode when the difference between the measured flow rate and the flow rate set point is less than the threshold.

6. The method of claim 1, further comprising updating the flow rate function based on measurements during the consecutive control cycles.

7. The method of claim 6, further comprising entering a tracking mode for a next control cycle in response to updating the flow rate function.

8. The method of claim 1, further comprising detecting a pump condition based on the pump speed and the measured flow rate.

9. The method of claim 8, wherein detecting the pump condition comprises detecting a leak in response to detecting a decrease in the measured flow rate when the pump runs at a constant speed, a change in pump current, and a change of a pulsation frequency.

10. The method of claim 8, wherein detecting the pump condition comprises detecting a wrong flow direction in response to the measured flow rate not changing after a duration of the wait sub-cycle.

11. The method of claim 8, wherein detecting the pump condition comprises detecting an incorrect tubing size condition based on a difference between an expected flow rate change based on the flow rate function and a measured flow rate change.

12. The method of claim 8, wherein detecting the pump condition comprises detecting a tubing degradation condition based on a motor current and flow rate, the method further comprising stopping the pump in response to the detection of the tubing degradation condition.

13. The method of claim 8, wherein detecting the pump condition comprises detecting a tubing high pressure condition in response to an increasing pump speed, an increasing pump current, and a difference between an expected flow rate and the measured flow rate being greater than a threshold.

14. The method of claim 8, wherein detecting the pump condition comprises detecting a tubing obstruction condition based on a pump motion profile, a difference between a local minimum flow rate and a local maximum flow rate, and a pulsation duration.

15. The method of claim 1, wherein determining the measured flow rate during the measurement sub-cycle comprises determining a mean flow rate based on a low-pass finite impulsive response (FIR) filter and an average filter during the measurement sub-cycle.

16. The method of claim 8, wherein detecting the pump condition comprises counting a number of control cycles to reach the flow rate set point from the measured flow rate.

17. A method of controlling a pump based on a pump speed and a downstream flow sensor, comprising:

determining a targeted motor speed for a flow rate set point based on a flow rate function;

controlling the pump according to consecutive control cycles, wherein each control cycle includes a pump movement sub-cycle, a wait sub-cycle, and a measurement sub-cycle;

determining a measured flow rate during the measurement sub-cycle, wherein a subsequent control cycle of the consecutive control cycles is based on the measured flow rate; and detecting a pump condition based on the pump speed and the measured flow rate;

wherein detecting the pump condition comprises at least one of (i) detecting an open pump head condition based on the measured flow rate being zero when the pump speed is greater than zero; (ii) detecting an incorrect tubing size condition based on a difference between an expected flow rate change based on the flow rate function and a measured flow rate change; and (iii) detecting a tubing obstruction condition based on a pump motion profile, a difference between a local minimum flow rate and a local maximum flow rate, and a pulsation duration.

18. A pump system, comprising:

a pump head configured to pump a fluid through a tube;

a motor configured to drive the pump head;

a flow sensor configured to measure a flow rate of the fluid in the tube downstream from the pump head; and a pump controller configured to:

determine a targeted motor speed for a flow rate set point based on a flow rate function;

control the motor according to consecutive control cycles, wherein each control cycle includes a pump movement sub-cycle, a wait sub-cycle, and a measurement sub-cycle;

determine a measured flow rate during the measurement sub-cycle, wherein a subsequent control cycle of the consecutive control cycles is based on the measured flow rate;

determine a predicted movement time of the pump movement sub-cycle for a motor of the pump to change from a current motor speed to the targeted motor speed;

determine a predicted wait time of the wait sub-cycle between a time that the pump will reach the targeted motor speed and a time that a flow rate detected by the downstream flow sensor will reach a flow rate corresponding to the targeted motor speed; and determine a measurement time of the measurement sub-cycle after the predicted wait time where the pump keeps a constant speed and the flow rate detected by the downstream flow sensor is stable.

19. A pump controller for controlling a pump based on a pump speed and a downstream flow sensor, comprising:

a memory storing computer-executable instructions; and at least one processor coupled to the memory and configured to execute the instructions to:

determine a targeted motor speed for a flow rate set point based on a flow rate function;

control the pump according to consecutive control cycles, wherein each control cycle includes a pump movement sub-cycle, a wait sub-cycle, and a measurement sub-cycle;

determine a measured flow rate during the measurement sub-cycle, wherein a subsequent control cycle of the consecutive control cycles is based on the measured flow rate;

determine a predicted movement time of the pump movement sub-cycle for a motor of the pump to change from a current motor speed to the targeted motor speed;

determine a predicted wait time of the wait sub-cycle between a time that the pump will reach the targeted motor speed and a time that a flow rate detected by the downstream flow sensor will reach a flow rate corresponding to the targeted motor speed; and determine a measurement time of the measurement sub-cycle after the predicted wait time where the pump keeps a constant speed and the flow rate detected by the downstream flow sensor is stable.

* * * * *